United States Patent [19]

Kempa

[11] Patent Number: 4,589,617

[45] Date of Patent: May 20, 1986

[54] FROG FOR SWITCHES

[75] Inventor: Bernd-Joachim Kempa, Berlin, Fed. Rep. of Germany

[73] Assignee: Elektro-Thermit GmbH, Berlin, Fed. Rep. of Germany

[21] Appl. No.: 689,519

[22] Filed: Jan. 9, 1985

Related U.S. Application Data

[63] Continuation of Ser. No. 140,870, Apr. 16, 1980, abandoned.

[30] Foreign Application Priority Data

Jun. 6, 1979 [DE] Fed. Rep. of Germany ..... 2922862

[51] Int. Cl.[4] ..... E01B 7/14

[52] U.S. Cl. ..... 246/388; 246/434; 246/468; 238/230; 238/281; 238/282

[58] Field of Search ..... 246/382, 383, 389, 468, 246/388, 438, 471, 434; 238/230, 281, 282

[56] References Cited

U.S. PATENT DOCUMENTS

| | | | |
|---|---|---|---|
| 542,253 | 7/1895 | Hamill | 246/388 |
| 612,273 | 10/1898 | Quigley | 246/388 |
| 1,011,087 | 12/1911 | Smith | 246/382 |
| 1,132,860 | 3/1915 | Livingston | 246/388 |
| 1,135,375 | 4/1915 | Hamilton et al. | 246/388 |
| 1,309,002 | 7/1919 | Walker | 246/388 |
| 1,488,443 | 3/1924 | Schwier | 246/388 |
| 2,124,804 | 7/1938 | Knight | 246/434 |
| 3,494,553 | 2/1970 | Nelson | 238/230 |
| 3,618,851 | 11/1971 | Smith | 238/281 |
| 3,757,113 | 9/1973 | Dohse | 246/382 |
| 4,005,839 | 1/1977 | Frank | 246/434 |

*Primary Examiner*—Richard A. Bertsch

*Attorney, Agent, or Firm*—Toren, McGeady, Stanger, Goldberg & Kiel

[57] ABSTRACT

This invention relates to an improvement in a frog for switches, in particular for rapid transit switches, with a junction rail mounted in a rotatable manner and adapted to close a gap between pairs of rails of straight or branch track, the improvement comprising that the two ends of the junction rail have the shape of an isosceles triangle and the corresponding ends of a transit rail taper on one side, whereby a continuous rail-head profile is formed when the junction rail abuts the transit rail.

9 Claims, 8 Drawing Figures

Fig. 4 (C-D)
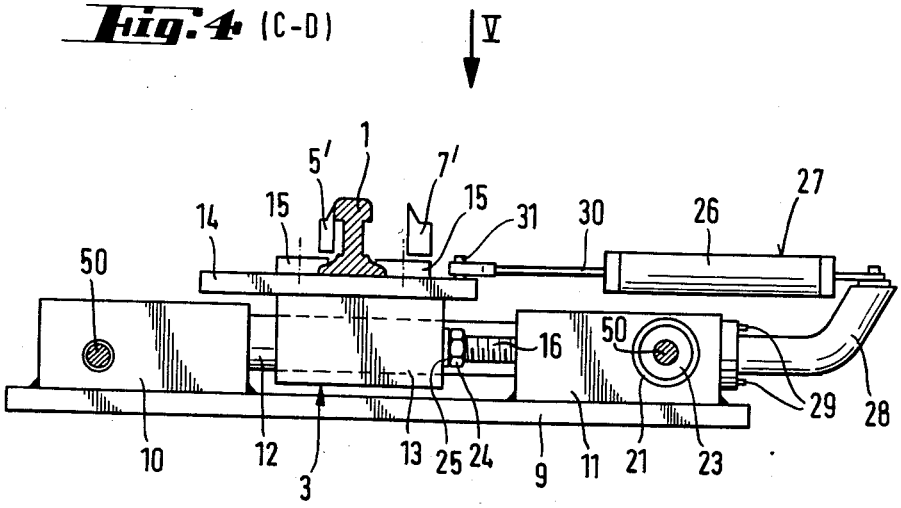
Fig. 5
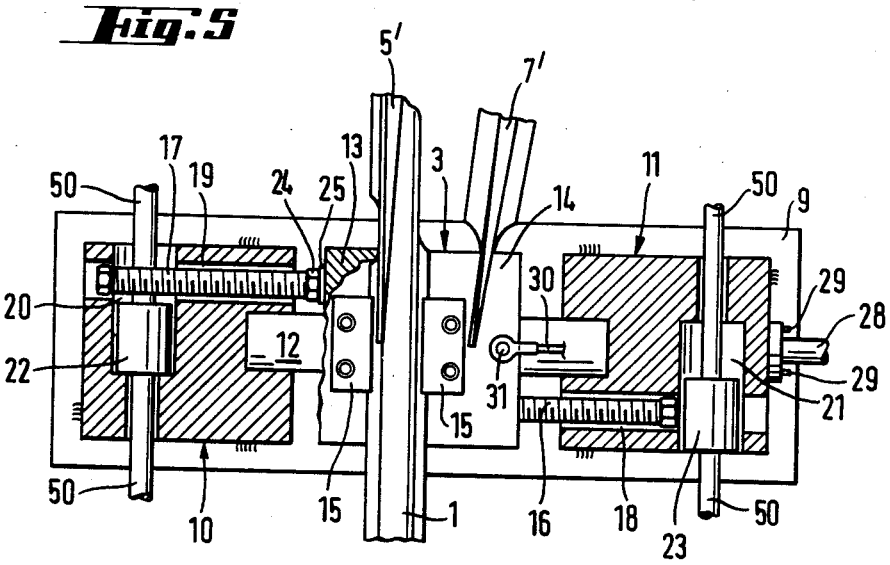

Fig. 6 (A-B)

FROG FOR SWITCHES

This is a continuation of application Ser. No. 140,870, filed Apr. 16, 1980, now abandoned.

This invention relates to frogs for switches, especially rapid transit switches, with a rotatably mounted junction rail closing the gap between the pairs of rails of the straight and branch-like tracks.

As the speed of travel steadily increases in modern rail traffic, the requirements on the railway superstructures also rise. The switches assume an important role in the railway superstructure when maximum speed is desired not only along the straight track but also on the turn-off track. The requirement to travel with maximum speed on the turn-off or branch track however requires that for a predetermined sideways acceleration not to be exceeded, the switches must be designed with a radius that is substantially larger than possible for present-day conventional switches.

Switches are known in the state of the art which are equipped,—for speeds on the straight track up to 250 km/h—with a frog design in which the gaps otherwise present in simple frogs are closed by adjustable elements.

It is further known to support frog tips in an articulated manner, the pivoting part being composed of a piece of rail. Thus German Gebrauchsmuster No. 7,045,928, describes a frog with a tip supported to an articulated manner for which the linkage is such that precise alignment of the riding edges of the frog tip and rails supposedly is achieved. Aside from the fact that such pivoting elements cannot be used in rapid transit switches on account of their sizes, such designs also form butted gaps.

U.S. Pat. No. 1,146,888, describes a frog for which the incoming and ongoing rails terminate at a determined spacing in front of their common intersection and wherein a rail slidingly supported on a plate joins together the ends corresponding to the direction of travel. While this design provides a rail head profile which is continuous in the frog, butt joints are formed on the other hand between the sliding rail and the incoming and ongoing rails, the butt joints being affected by their generally known drawbacks. Further, these frogs can be used only in switches wherein straight rails cross in the frog area.

The above frog designs furthermore are unsuited for the rapid transit switch region because as the switch radius increases, the junction rails become ever longer and their stability reaches a point at which frogs with loosely resting junction rails no longer can be used for reasons of safety.

It is the object of the invention to avert the drawbacks of the known systems and to create a continuous rail head profile without butt joints in the area of the frog.

This problem is solved by the invention by designing both ends of the junction rail as isosceles triangles, the corresponding ends of the transit rails to be pointed on one side while forming a continuous rail head profile.

A frog means of which the junction rail is solidly fixed by its ends of slide seats and rests on rail supports is especially preferred.

Thereby a continuous rail head profile is achieved both in the straight and the branched track, and an abrupt change in elasticity is thus avoided. The pointed symmetrically shaped ends of the junction rail and the ends of the transit rails of the same length and in the shape of tongue profiles complement one another when mutually resting against each other so as to form a complete rail head profile and allow a quiet, smooth passage of the wheels thereon.

The horizontal adjustment of the junction rail is appropriately implemented by known sliding seats to which the junction rail is rigidly mounted. These slide seats allow the mutually opposite transverse motion of the ends of the junction rail when it is rotated, by means of which rotation the sharp ends of the junction rail are made to rest against the ends of the transit rails. The differential slopes of the ends of the transit rails which are chamfered across the entire width of the head on one hand and of the ends of the junction rail tapering at both ends into sharp points which are bevelled with respect to the center line of the rail head on the other hand, are compensated by elastically bending the junction rail by half a head width. Thereby is created the continuous rail head profile. As regards switches for which the radius of the branched track passes through the frog, the junction rail is elastically bent along its entire length corresponding to this radius for the "turn-off" position and made to rest against the bending rail. The slide seats further ensure that by means of locking elements mounted therein the junction rail - which is stressed when touching - be immovably supported in its straight or turn-off position.

The use and functioning of the slide seats is comprehensively described in German Offenlegungsschrift No. 2,817,782. The slide seats also absorb the horizontal and vertical forces exerted by the wheels rolling over the system. The rail supports located between the slide seats and to which the transit rails and their tongue-profiled ends are rigidly mounted in addition are used to support the junction rail.

It was found to be advantageous that the junction rail include a center part corresponding to the rail profile, the sharp ends being welded onto the center part.

Depending upon the geometry of the switch, the size of the junction rail in the frog area will vary. The two ends of this junction rail shaped like isosceles triangles preferably are symmetrical. In order to make the junction rail of the length required for the particular switch geometry, the sharp ends are welded to a center piece selected to be of a corresponding size and thus the junction rail will be of the desired length.

A further feature of the invention is that the transit rails are mounted with their tongue-shaped ends on rail supports and rest on slide seats.

Preferably the rail support is composed of a bed which by means of bed plates is connected with a chock welded to a common base plate.

Advantageously, the rail support is adjustable both horizontally and vertically. The horizontal adjustment permits correcting the transit rails in the track. The vertical adjustment permits obtaining both oblique positions of the substructure and of the rails.

The vertical adjustment is implemented by wedges inserted between the chock bed plates and the bed.

Horizontal adjustment is implemented by an elongated slot in the chock base plates.

The invention achieves butt-free junction with the transit rails, the particular position of the transversely displaceable junction rail being immovably secured by the rigid mounting to the slide seats.

The invention is shown below in relation to the drawings, and is explained as follows in further detail:

FIG. 4 is a side view of the section C-D of FIG. 7, FIG. 5 is the top view of FIG. 4.

Figure 1:
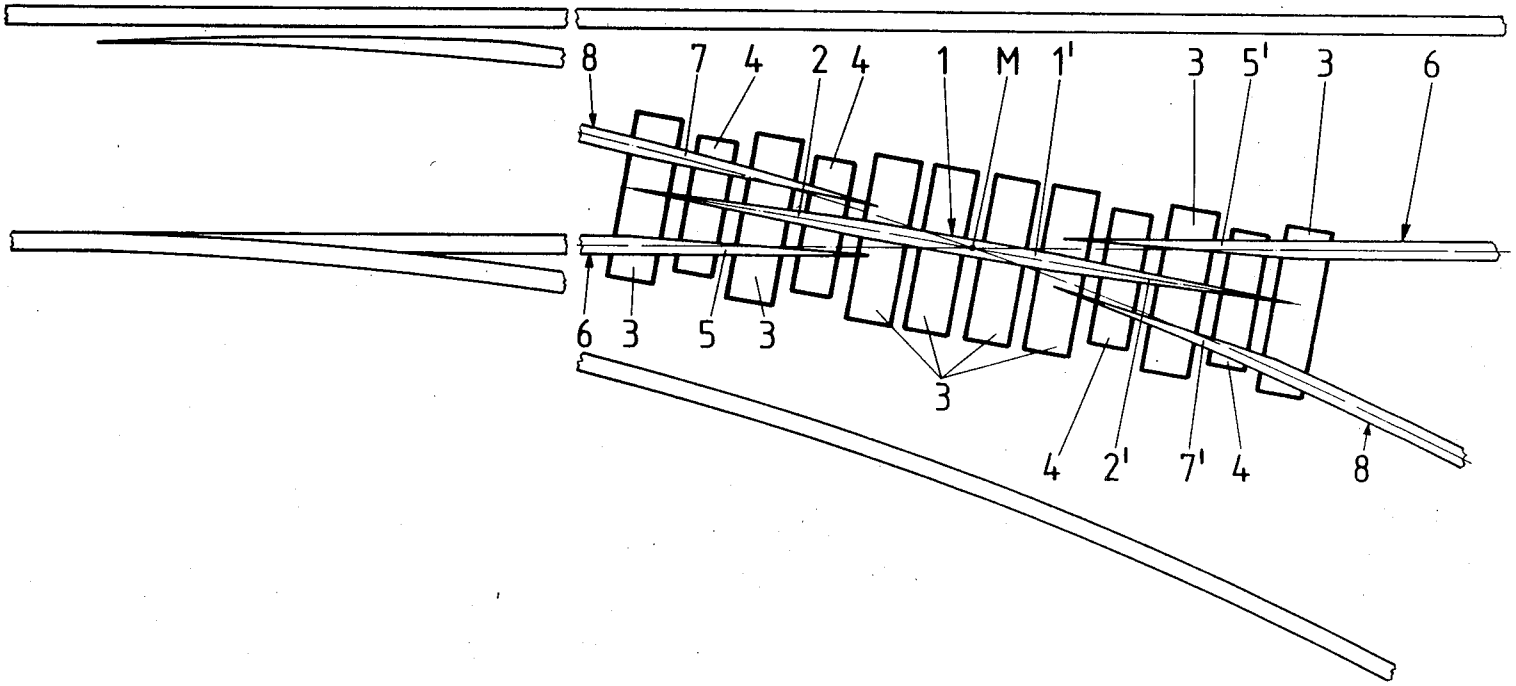
FIG. 1 is a top view of a frog means in a switch.

FIG. 1 shows a tongue switch with the frog of the invention in schematic form. The frog is composed of the junction rail 1 pivotally supported about the intersection M with tapered ends 2, 2' and the center piece 1' with a rail profile, the transversely displaceable slide seats 3 on which is fastened the junction rail 1, the solidly fixed rail supports 4 on which are mounted in rigid manner the tongue-shaped transit rail ends 5, 5', the transit rail 6 of the main track interrupted within the frog, and the transit rail ends 7,7' comprising tongue-shaped profiles of the transit rail 8, of the branch track interrupted within the frog.

Figure 2:
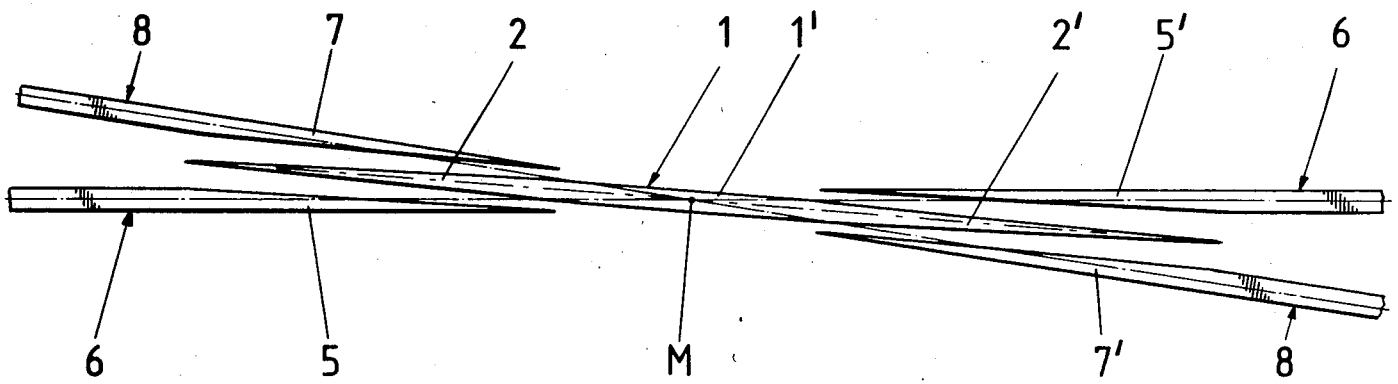
FIG. 2 is a top view of the frog area.

FIG. 2 shows the junction rail 1 rotatable about the intersection M and transversely displaceable with respect to the pointed ends and fastened to the slide seats 3 when in its center position (not touching). The ends 2, 2' of the junction rail 1 are of tongue-shaped design.

The ends 5, 5' and 7, 7' of the transit rails 6 and 8 are designed in a tongue-shaped profile on one side along the same length as the ends 2, 2' of the junction rail 1.

Figure 3:
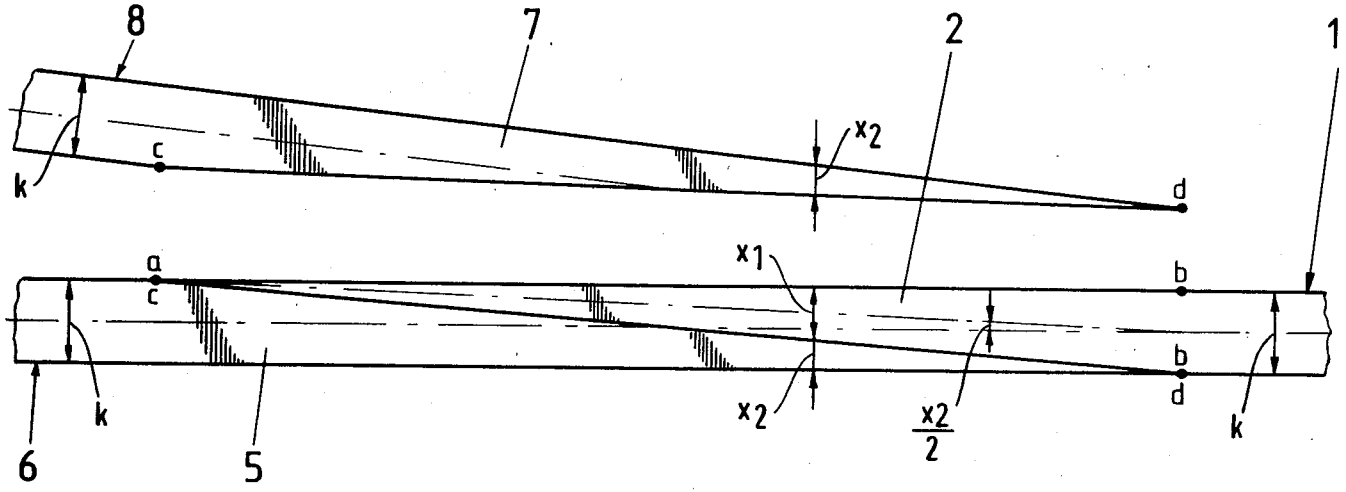
FIG. 3 is a top view of the left part of the frog, of FIG. 2, on a larger scale.

Only the left part of the frog of FIG. 2 is shown in FIG. 3 for greater clarity and on an enlarged scale. The end 2 of the junction rail 1 is shown resting in shape-locking manner against the end 5 of rail 6. The lateral length (c) through (d) of the transit rail ends 5 and 7 corresponds to the lateral length (a) through (b) of the end 2 of the junction rail 1. When switching horizontally, first point (a) of end 2 of the junction rail 1 comes to rest against point (c) of ends 5 and 7. Until the final position of the connecting rail is achieved, its end 2 will be bent along its lateral length from (a) to (b) in elastic manner by half the width of the rail head k from point (b) on. The terms $x_1$ and $x_2$ correspond to the remaining rail head width following processing, each one assuming values larger than zero and less than k. The bending of the junction rail 1 at all points is equal to $\frac{1}{2}x_2$. The end 2 of the connecting rail 1 and the ends of the transit rails 5 and 7 are so shaped that the condition $k=x_1+x_2$ is met. The term K is the width of the rail head.

FIGS. 4 and 5 show the support and the guidance of the junction rail formed from the transit rail being rotatable and transversely displaceable in the area of the tongue. The support chocks 10 and 11 are solidly joined by welding to the base plate. The shaft 12 is fitted into the bores of the chocks 10 and 11. A slide seat 3 composed of the support chock 13 and the plate 14 mounted thereon is supported in sliding manner on the shaft 12. The fastening of the junction rail 1 is carried out by the clamping pieces 15 which are screwed together with the plate 14 by means of countersunk screws. The clamping pieces 15 at the same time act as a support point at this location for the vertical loads exerted on the rail ends 5' and 7'. The threaded bars 16 and 17 ensure locking the junction rail 1 into the particular stressed position required by the switch geometry. The threaded bars 16 and 17 in the clearances 18 and 19 respectively set up the precisely defined spacing for the locking elements 22 and 23 respectively housed in the clearances 20 and 21 respectively. The threaded bars 16 and 17 are held in place by hexagonal nuts 24 and washers 25.

The junction rail 1 mounted on the slide seat 3 is moved transversely by means of the differential cylinder 26. The cylinder housing 27 is connected in force-locking manner by means of the arm 28 and bolts 29 with the support chock 11. The piston rod 30 carrying out the transverse motion acts on the slide seat 3 by means of the support point 31 at the plate 14.

Figure 6:
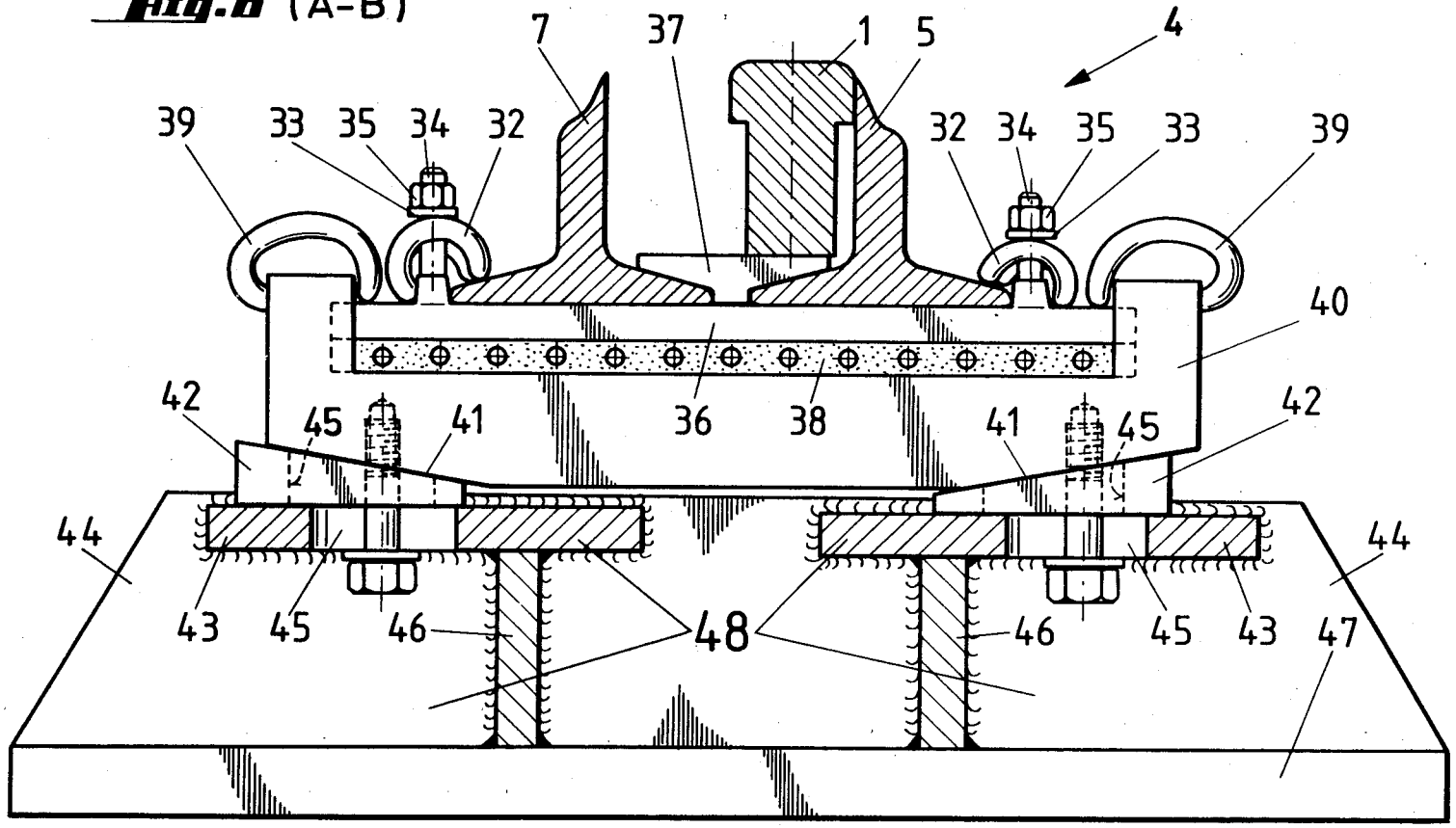
FIG. 6 is the side view of the section A-B of FIG. 7, and FIGS. 7 and 8 are top views of the frog in its two end positions.

FIG. 6 shows the rail support 4 of the rigidly mounted rail ends 5 and 7 with tongue-shaped profiles. It is formed essentially by the bed 40 and the chock 48, which are welded on the foundation plate 47. The rail ends 5 and 7 are connected by the clamping means 32, the washers 33, the hook bolts 34 and the hexagonal nuts 35 at the outside of the slab 36. The clamping piece 37 is located between the rails 5 and 7, acting as a spacer and fastening means, and futhermore supporting at this location the junction rail 1 with respect to vertical loads.

To ensure the required dipping of the rails when the load passes over the track, the slab 36 is placed on a rubber plate 38 adjusted for pressure. Lifting forces are compensated by the clamping yokes 39. In order to permit subsequent vertical correction, the support 40 includes chamfers 41 at its two lower sides. These chamfers 41 of bed 40 are adapted with the wedges 42 thereunder in a precise fit, these wedges then permitting the adjustment.

The bed plates 43 welded to the chock 48 are provided with elongated slots 45 just as the wedges 42, these slots additionally also allowing horizontal adjustment transversely to the transit rails 4 and 5.

By using chamfers 41 on bed 40 and inserting the wedges 42 between it and the bed plate 43, both the slants of the ground can be compensated and the desired slanted positions of the rails can be obtained.

The side parts 44 together with the transverse ribs 46 are both welded to the base plate 47 and form the chock 48 bearing the bed 40.

Figure 7:
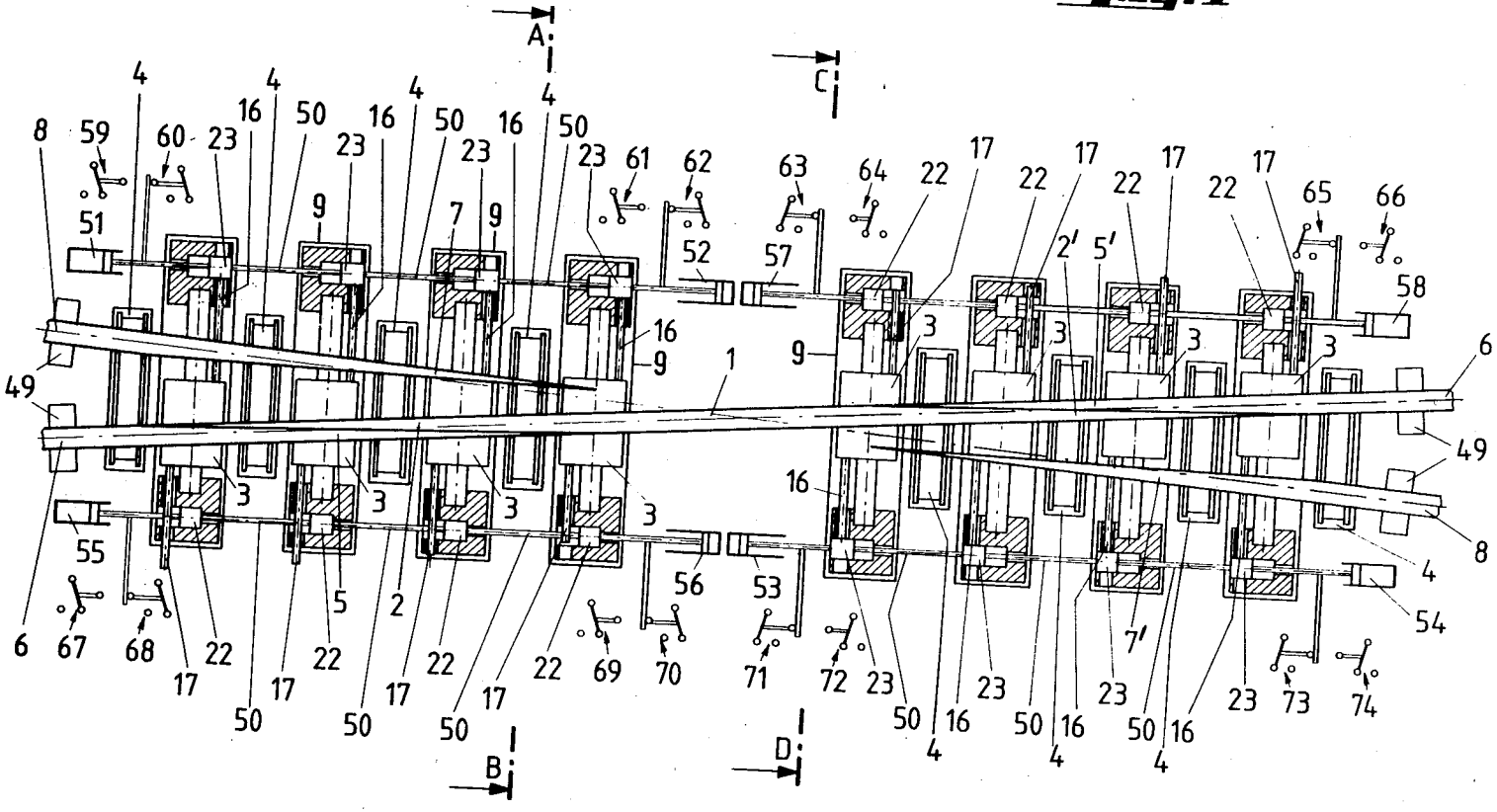
Figure 8:
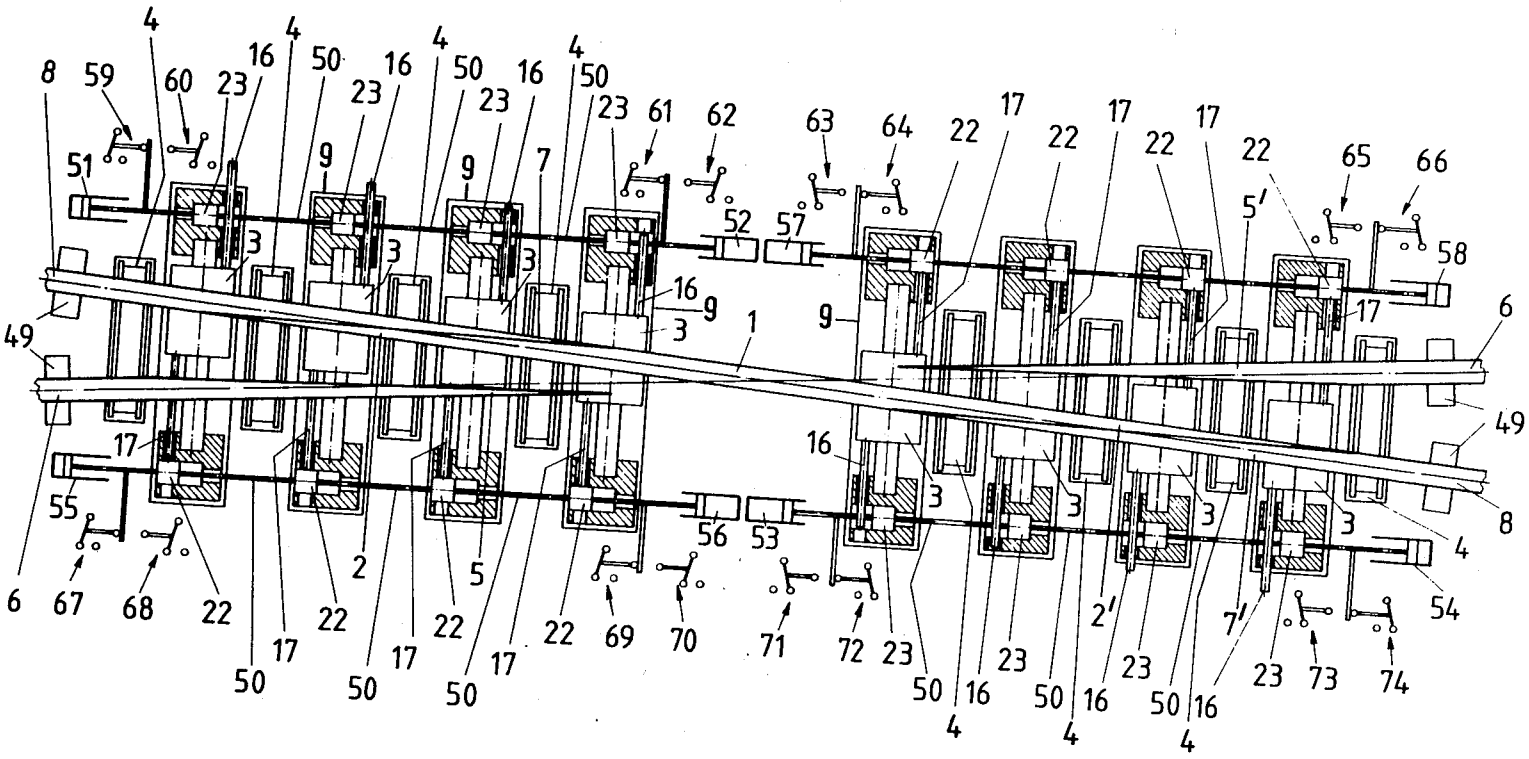

FIGS. 7 and 8 show the junction rail 1 when being switched from "straight"(FIG. 7) to the branched position (FIG. 8). The connecting rail 1 is in the stressed state, resting against the ends 5, 5' of the transit rail 6. The rigid rail ends of the transit rails 6 and 8 are connected by the slabs 49 to the substructure. Within the area of the frog, these rails are mounted on the rail supports 4 and rest loosely on the slide seats 3. The transversely displaceable junction rail 1 is fastened to the slide seats 3 and rests loosely on the rail supports 4. The locking elements 22, 23 located in the slide seats 3 in each case are mutually connected on both sides to the linkage system 50. The switching of the locking elements 23 in the left-hand part of the frog takes place by means of the unilaterally acting cylinders 51, 52 and in the right hand part of the frog by the unilaterally acting cylinders 53, 54. The switching of the locking elements 22 in the left-hand part of the frog is implemented by the unilaterally acting cylinders 55, 56 and in the right-hand part of the frog by the unilaterally acting cylinders 57, 58. Determination of the proper position of the locking elements 22, 23 is implemented by the limit switches 59, 60, 61, 62, 63, 64, 65, 66, 67, 68, 69, 70, 71, 72, 73, and 74. In the "straight" position (FIG. 7), the actuating cylinders 55, 58 move the locking elements 22 by means of the linkage system 50 into the unlocked position. This actuates the limit switches 63, 65, 68, and 70, while the limit switches 64, 66, 67, and 69 are deactivated. The actuating cylinders 51, 54 move the locking elements 23 into the locked position. This activates limit switches 60, 62, 71, and 73 while limit switches 59, 61, 72, and 74, are deactivated. This combination of limit switches permits clearing the transit for the straight track.

Reliable and immovable locking of the transversely displaceable connection rail 1 is implemented by the locking elements 23 acting as a support for the threaded bars 16 for the purpose of maintaining the stressed connecting rail 1 against the rail ends 5, 5'.

The switching from the "straight" position as shown in FIG. 7 to the "turn-off" or branched position (FIG. 8), takes place as follows:

The differential cylinders 26 shown in FIG. 4 are actuated in such a manner that the junction rail 1 first is strongly pressed against the rails 5, 4', whereby the threaded bars 16 slightly move away from the locking elements 23. After the locking elements 23 are free, the actuating cylinders 52, 53 are activated and the locking elements 23 are moved into the unlocked position by means of linkage 50. If this switching process takes place in the proper order, the limit switches 59, 61, 72, and 74, and 60, 62, 71, and 73, must be now activated and deactivated respectively. This position of the limit switches initiates the reversal of the direction of the force at the differential cylinders 26. The differential cylinders press the junction rail 1 into the turn-off position and then force it against the rigid rail ends 7, 7' in such a manner that the path is clear for the locking elements 22 for the ensuing locking. Presently the actuating cylinders 56, 57 can move the locking elements 22 by means of the linkage 50 into the locked position. When the drive compression for the differential cylinders 26 is shut off, the threaded bars 17 are subjected to the force from the compression between the junction rail 1 and the rail ends 7, 7' which pushes it against the locking cylinder 22. If the locking is proper, the limit switches 64, 66, 67, and 69, must be actuated and the limit switches 63, 65, 68 and 70, must be deactivated. For this position of the limit switches, the hydraulic drive is inoperative.

The transit clearance for the branch track can be obtained by the combination shown in FIG. 8 of the limit switch position, in which switches 59, 61, 64, 66, 67, 69, 72, and 74, are activated and switches 60, 62, 63, 65, 68, 70, 71, and 73, are deactivated.

It will be obvious to those skilled in the art that many modifications may be made within the scope of the present invention without departing from the spirit thereof, and the invention includes all such modifications.

What I claim is:

1. A switch for high-speed running railway track comprising:

a frog having a junction rail mounted in a rotatable manner, said junction rail being arranged to close a gap between the pairs of rails of straight track and branch track, a rail of straight or branch track being designated as a transit rail; said junction rail having its ends formed in the shape of an isosceles triangle and wherein the corresponding ends of the transit rail are tapered on one side only, each tapered end of a transit rail being equal in dimension to one side of the isosceles triangle of the junction rail; the ends of the junction rail being subject to elastic deformation to provide a continuous railhead profile during engagement between the junction rail and the tapered end of the transit rail.

2. A switch for high-speed running railway track in accordance with claim 1 wherein the untapered portion of the junction rail and the untapered portion of the transit rail have the same width and wherein, during engagement between the junction rail and the transit rail, the sum of the width of the tapered portion of the junction rail and the corresponding width of the tapered portion of the transit rail, at any point along the taper, is equal to the untapered width of the transit rail.

3. A switch for high-speed running railway track in accordance with claim 1 including slide seat means for supporting the ends of the junction rail and rail support means upon which the junction rail rests.

4. A switch according to claim 1 in which the junction rail includes a center portion having a profile which corresponds to the transit rail profile and to which center portion the pointed ends are welded.

5. A switch according to claim 1 including stop means which are provided for holding the ends of the junction rail pressed sufficiently firmly against the respective transit rails to be tensioned into a deformed condition to provide a smooth transition between the junction rail and the transit rail.

6. A switch for high-speed running railway track comprising:

a frog having a junction rail mounted in a rotatable manner, said junction rail being arranged to close a gap between the pairs of rails of straight track and branch track, a rail of straight or branch track being designated as a transit rail; said junction rail having its ends formed in the shape of an isosceles triangle and wherein the corresponding ends of the transit rail are tapered on one side only, each tapered end of a transit rail being equal in dimension to one side of the isosceles triangle of the junction rail; the ends of the junction rail being subject to elastic deformation to provide a continuous railhead profile during engagement between the junction rail and the tapered end of the transit rail and including means for mounting the transit rail by their tongue profile shaped ends on rail support means and further including side seat means on which transit rails rest.

7. A switch according to claim 6 in which the rail support means includes a bed which by means of bed plates is connected to a chock welded onto a common base plate.

8. A switch according to claim 7 in which the rail support means is vertically adjustable by wedge means inserted between the bed plates of the chock and the bed.

9. A switch according to claim 7 in which rail support means is horizontally adjustable by means of elongated slots in the bed plates of the chock.

* * * * *